US005551263A

United States Patent [19]

Myers et al.

[11] Patent Number: 5,551,263

[45] Date of Patent: Sep. 3, 1996

[54] LOCK WITH DEAD BOLT CAMMING ACTION ON 90 DEGREE LOCK CYLINDER ROTATION

[75] Inventors: Gary L. Myers, Monee; Aurelia C. Haiduc, River Grove, both of Ill.

[73] Assignee: Fort Lock Corporation, River Grove, Ill.

[21] Appl. No.: 295,558

[22] Filed: Aug. 25, 1994

[51] Int. Cl.[6] ..... E05B 65/46

[52] U.S. Cl. ..... 70/86; 70/134; 70/379 R

[58] Field of Search ..... 70/389, DIG. 6, 70/379 R, 379 A, 380, 134, 85–88; 292/140, DIG. 52

[56] References Cited

U.S. PATENT DOCUMENTS

| | | | |
|---|---|---|---|
| 1,076,587 | 10/1913 | Lapidus | 70/389 |
| 1,560,503 | 11/1925 | Doenges | 70/231 |
| 1,730,396 | 10/1929 | Van Sickel | 70/252 |
| 1,903,765 | 4/1933 | Johnson | 70/379 R |
| 2,035,781 | 3/1936 | Bell | 70/86 |
| 2,580,882 | 1/1952 | Blohm | 70/DIG. 62 X |
| 3,006,179 | 10/1961 | Erickson | 70/379 R |
| 3,390,557 | 7/1968 | Erickson et al. | 292/140 X |
| 3,824,817 | 7/1974 | Orr | 70/134 X |
| 4,899,563 | 2/1990 | Martin | 70/370 X |
| 5,212,972 | 5/1993 | Kincaid et al. | 70/379 R X |
| 5,265,454 | 11/1993 | Crocco et al. | 70/380 |

FOREIGN PATENT DOCUMENTS

| | | | |
|---|---|---|---|
| 31172 | 5/1885 | Germany | 70/134 |
| 1158865 | 12/1963 | Germany | 70/86 |
| 15542 | of 1886 | United Kingdom | 292/140 |

*Primary Examiner*—Lloyd A. Gall
*Attorney, Agent, or Firm*—Leydig, Voit & Mayer, Ltd.

[57] ABSTRACT

A standard "diamond back" lock configuration, as used in drawer locks, includes a dead bolt with an angled slot. The angled slot provides an improved camming action which produces the same amount of linear dead bolt motion with 90° of lock plug rotation as a conventional, non-angled slot with 180° of rotation. In addition, since only 90° of rotation is necessary to fully extend or retract the dead bolt, a user can ascertain whether the lock is engaged or not by the relative orientation of the keyway entry. Also, with 90° of lock plug rotation, key retention at the unlocked position can be provided as an added feature of the lock.

2 Claims, 1 Drawing Sheet

LOCK WITH DEAD BOLT CAMMING ACTION ON 90 DEGREE LOCK CYLINDER ROTATION

BACKGROUND OF THE INVENTION

1. Field of the Invention

The present invention relates generally to locks, and, more particularly, concerns a lock assembly with an improved dead bolt cam configuration which permits the full extension or retraction of a dead bolt upon a 90° rotation of the lock cylinder. Dead bolt lock assemblies of this type are commonly, but not exclusively, employed as drawer locks. The preliminary form of such a lock was disclosed in Disclosure Document No. 358,463, filed in the U.S. Patent and Trademark Office on Jul. 19, 1994.

2. Description of the Prior Art

Generally, drawer locks are comprised of a cylindrical lock plug which rotates within a lock housing and a dead bolt which moves linearly when the lock is rotated with a key. Located at the opposite end of the lock plug to where the key is inserted is a small cylindrical knob (cam) which fits into a slot cut within the dead bolt. When the lock plug is rotated within the lock housing, the cam moves within the dead bolt slot which, in turn, pushes the dead bolt along a channel formed on the lock housing and/or diamond shaped mounting flange. This interaction between the cam and the dead bolt slot provides the dead bolt with its linear back-and-forth motion.

Drawer locks customarily contain a dead bolt with a single slot oriented at a right angle to the direction of linear dead bolt travel (i.e. a non-angled slot). With this type of construction, 180° of lock rotation is required to fully extend (lock) or retract (unlock) the dead bolt. Since 180° of rotation is necessary to lock or unlock the drawer, the keyway slot will be at the same orientation (usually vertical) at both of these positions, which makes it virtually impossible for a user to visually determine whether the drawer is locked or not. This type of non-angled dead bolt slot fabrication is well known within the art.

Drawer locks also commonly have two or four equally spaced axial splines formed within the inner cylindrical contour of the lock housing which provide sites at which the key may be removed. When a properly fitted key is inserted into the lock plug, a tumbler mechanism within the lock is engaged and the tumblers become flush with the outer cylindrical contour of the lock plug which permits it to freely rotate within the inner cylindrical contour of the lock plug housing. The key, however, cannot be removed at non-spline locations because if it is partially extracted from the keyway entry, the tumblers disengage and spring load against the inner contour of the lock plug housing, which does not prevent subsequent lock rotation, but precludes any further extraction of the key. Yet, when the key is ultimately rotated to an orientation corresponding to a spline, the tumblers unload and fully release into the spline and the key may be removed, but any further rotation of the lock is obstructed by the contact between the disengaged tumblers and the spline. In sum, a key may not be removed at non-spline locations but may be freely withdrawn at any spline location, unless a spline filler insert is placed there. As a result, dual spline prior art drawer locks cannot incorporate a key retention feature at the unlocked position without the aid of a spline filler insert since both the locked and unlocked positions are oriented 180° apart and coincide with spline locations.

Drawer locks also typically utilize lock plugs with disengageable retention mechanisms, usually a disk spring located near the opposite end of the lock plug to where the key is inserted, which, when engaged, seats upon a flange situated at the end of the inner contour of the lock plug housing. Such a mechanism holds the lock plug axially in place, but permits it to rotate within the lock plug housing.

OBJECTS AND SUMMARY OF THE INVENTION

The primary object of the present invention is to provide the same amount of linear dead bolt motion that the prior art achieves in 180° of lock plug rotation in one-half the amount of turning, or 90° of rotation. This goal is accomplished through the use of a dead bolt with an angled slot which provides superior camming action between the rotating lock plug cam and the translating dead bolt.

A related object of the invention is to provide users with a method of ascertaining whether a drawer lock is engaged or not by visually examining the orientation of the keyway slot. The invention, unlike conventional dead bolt drawer locks, requires only 90° of rotation to lock or unlock the drawer. Therefore, the keyway slot will be at right angles in the locked and unlocked positions (usually vertical and horizontal, respectively) which makes it relatively simple for a user to view the lock and determine whether it is engaged or not.

A further object of the invention is to provide a means of key retention, without the use of spline filler inserts, whereby the key is not removable at the unlocked position. This objective is achieved by way of a standard dual spline formed within the inner cylindrical contour of the lock plug housing oriented 180° apart. Since a key can only be removed where the tumblers of the lock engage a spline, and since there is no spline located at the unlocked (or 90°) position, the key will not be removable at the unlocked position even without a spline filler insert.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
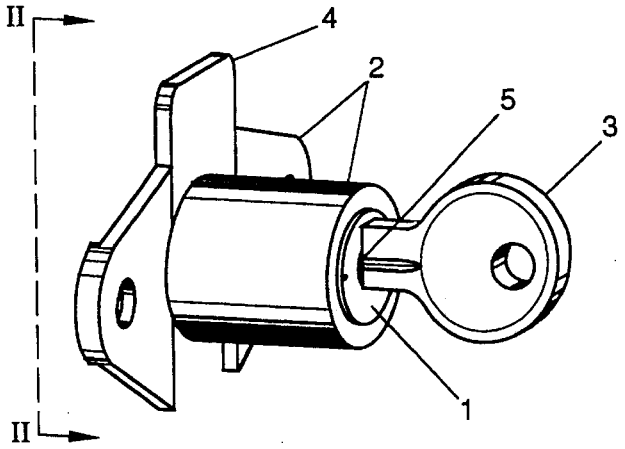
FIG. 1 (PRIOR ART)
FIG. 1 is a perspective view of the drawer lock assembly and its component parts.

Turning now to the drawings, FIG. 1 illustrates a typical prior art drawer lock assembly comprising: a cylindrical lock plug 1; a lock housing-diamond back assembly unit 2; a key 3; and a dead bolt 4. The key 3 fits within the lock plug 1 by way of a keyway entry 5 which in the present instance is a slot for a flat key with the lock housing having a plurality of disk tumblers (not shown). If the key 3 properly engages the tumbler mechanism inside, the lock plug 1 can be rotated within the inner cylindrical contour of the lock housing-diamond back assembly unit 2.

Figure 2:
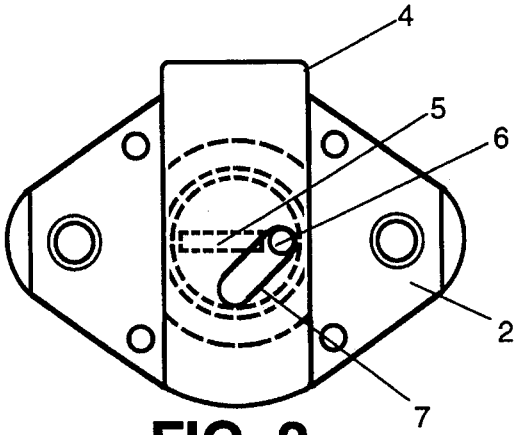
FIG. 2 is a side view of the drawer lock assembly with the dead bolt in the unlocked position and a partial sectional view of the end portion of the cylinder lock as seen in the direction of line 2—2 in FIG. 1.
Figure 4:
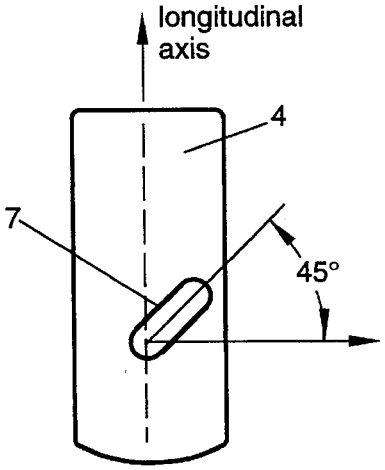
FIG. 4 is a front view of the dead bolt for the claimed invention.

FIG. 2 shows a side view of a drawer lock assembly in accordance with the present invention in the unlocked position (i.e. the dead bolt 4 is fully retracted). Here, as in the prior art, a small cylindrical projecting cam in the form of a pin 6, located at the opposite end of the lock plug 1 to where the key 3 is inserted and offset from the outer diameter of the lock plug 1, fits into a cam follower slot 7 within the dead bolt 4. In the preferred embodiment, the dead bolt slot 7 is at a 45° angle with respect to the longitudinal axis of the dead bolt 4 as shown in FIG. 4.

Figure 3:
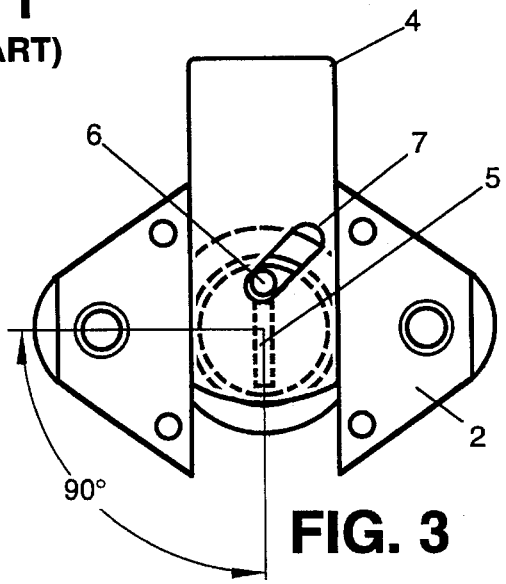
FIG. 3 is also a side view of the drawer lock assembly and a partial sectional view of the end portion of the cylinder lock as seen in the direction in line 2—2 of FIG. 1, but with the dead bolt in the locked position.
Figure 5:
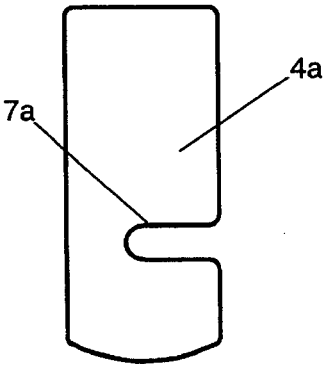
FIG. 5 (PRIOR ART)
FIG. 5 is a front view of a conventional prior art dead bolt.

FIG. 3 depicts the same view as FIG. 2 except that the lock plug 1 has been rotated 90° to the locked position (i.e. the dead bolt 4 is fully extended). As the key 3 rotates the lock plug 1 from the position in FIG. 2 to the position in FIG. 3, the cam 6 traverses from one end of the angled dead bolt slot 7 to the other and pushes the dead bolt 4 outward along a channel formed into the lock housing 2 to its fully extended (or locked) position. In contrast, a prior art dead bolt **4*a* with a non-angled slot 7*a*, such as the one depicted in FIG. 5**, requires a full 180° of rotation to produce complete dead bolt extension or retraction. Thus, the invention yields the same amount of linear dead bolt travel as the prior art, typically an industry convention of about 11/32", but in one-half the rotation.

The invention also provides users with an alternative means of determining whether a drawer is locked or not by visually examining the relative orientation of the keyway entry 5. As mentioned above, conventional prior art dead bolt drawer locks require 180° of key 3 rotation to completely engage or disengage the dead bolt **4*a*, and, as such, the keyway entry slot 5 will be at the same orientation, usually vertical, in both the locked and unlocked positions. The invention, in contrast, requires only 90° of key 3 rotation to fully actuate the dead bolt 4. As such, the keyway entry 5 will be at right angle orientations in the unlocked and locked positions, respectively (as shown in FIGS. 2 and 3), which makes it easy for users to visually ascertain whether the lock is engaged. For a comparison between a dead bolt 4 with an angled slot 7, as used in the invention, and a typical prior art dead bolt 4*a* with a non-angled slot 7*a* refer to FIGS. 4 and 5, respectively. As seen also in FIG. 1, the dead bolt extends from an end of the rectangular channel and is positioned at opposite open sides of the channel above the plug 1**, whereby the bolt may be positioned immediately adjacent to a drawer panel.

In addition, unlike dual spline prior art drawer locks which cannot include key retention at the unlocked position without the use of a spline filler insert, a dual spline embodiment of the invention (not shown) can accommodate a key retention feature at the unlocked position, even without the use of a spline filler insert, since only 90° of rotation is required to go from the locked to the unlocked position and since splines are located at 180° intervals, and not every 90°. the 180 degree intervals allow the lock plug to be rotated to an angle of 180 degrees when actuating the dead bolt.

We claim:

1. An improved drawer lock assembly adapted to be mounted to a drawer panel, the drawer lock assembly comprising, in combination:

a lock plug housing having a cylindrical opening formed therethrough and a rectangular channel with substantially parallel side walls formed thereon, the cylindrical opening of the lock plug housing having a longitudinal axis, the rectangular channel arranged substantially perpendicular to the longitudinal axis of the cylindrical opening;

a key operated lock plug rotatably disposed in the cylindrical opening of the lock plug housing, the lock plug having a key entry way disposed on one end and an offset projecting cam member disposed on the opposite end; and a dead bolt slidably disposed within the rectangular channel, the rectangular channel having opposite open ends, from one end of which the dead bolt extends in its fully extended position, and opposite open sides positioned radially outward from the lock plug housing, whereby the dead bolt may be positioned immediately adjacent to a drawer panel when mounted to the drawer panel, the dead bolt having a longitudinal axis and a linear slot oriented at substantially a 45° angle with respect to the longitudinal axis of the dead bolt, the linear slot receiving the projecting cam member of the lock plug, the projecting cam member linearly actuating the dead bolt between a fully withdrawn position and a fully extended position when the lock plug is rotated 90°, the linear slot permitting the lock plug to be rotated to an angle of 180° when actuating the dead bolt.

2. A drawer lock assembly as defined in claim 1 wherein the lock plug housing includes a diamond shaped mounting flange.

* * * * *